US008196747B2

(12) United States Patent
Stegner et al.

(10) Patent No.: US 8,196,747 B2
(45) Date of Patent: Jun. 12, 2012

(54) END CAP PACKAGING MATERIAL, PACKAGING AND METHOD FOR PROTECTING PRODUCTS AGAINST DAMAGE

(75) Inventors: Eric Allen Stegner, Durham, NC (US); Robert William Stegner, Raleigh, NC (US); Christopher John Sattora, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 975 days.

(21) Appl. No.: 11/295,063

(22) Filed: Dec. 6, 2005

(65) Prior Publication Data

US 2007/0125683 A1 Jun. 7, 2007

(51) Int. Cl.
*B65D 85/30* (2006.01)

(52) U.S. Cl. ..... 206/592; 206/588; 206/586; 206/523

(58) Field of Classification Search ..... 206/521, 206/523, 588, 591, 592, 525, 522, 521.2, 206/521.8, 586, 453, 320, 594; 220/732, 220/902; 229/920; 53/472
See application file for complete search history.

(56) References Cited

U.S. PATENT DOCUMENTS

| | | | | | |
|---|---|---|---|---|---|
| 1,892,527 | A * | 12/1932 | Gray | 206/591 |
| 2,044,048 | A * | 6/1936 | Boeye | 206/592 |
| 2,050,909 | A * | 8/1936 | Woodall | 220/694 |
| 2,667,968 | A * | 2/1954 | Ritchie | 206/499 |
| 2,825,449 | A * | 3/1958 | Britt et al. | 206/724 |
| 3,752,301 | A * | 8/1973 | Bluemel | 206/583 |
| 3,768,724 | A * | 10/1973 | Hill | 206/523 |
| 3,901,385 | A * | 8/1975 | Rosen et al. | 206/320 |
| 3,938,661 | A * | 2/1976 | Carmody | 206/523 |
| 4,122,946 | A * | 10/1978 | Holley | 206/523 |
| 4,627,956 | A * | 12/1986 | Botzem et al. | 376/272 |
| 4,972,954 | A * | 11/1990 | Dickie | 206/523 |
| 5,160,473 | A * | 11/1992 | Bontrager | 264/138 |
| 5,407,090 | A * | 4/1995 | Boots | 220/62.18 |
| 5,628,402 | A * | 5/1997 | Dickie et al. | 206/521 |
| 5,636,744 | A * | 6/1997 | Hirose | 206/586 |
| 5,772,025 | A * | 6/1998 | Chen et al. | 206/320 |
| 5,803,263 | A * | 9/1998 | Pozzo | 206/522 |
| 6,076,677 | A * | 6/2000 | Pozzo | 206/522 |
| 6,405,866 | B2 * | 6/2002 | Arima | 206/453 |
| 6,464,079 | B1 * | 10/2002 | Newman | 206/522 |
| 6,499,599 | B1 * | 12/2002 | Hopkins et al. | 206/523 |
| 6,520,333 | B1 * | 2/2003 | Tschantz | 206/522 |
| 6,520,337 | B2 * | 2/2003 | Smith | 206/592 |
| 2004/0055928 | A1 | 3/2004 | Smith | 206/586 |
| 2004/0055929 | A1 | 3/2004 | Smith | 206/591 |
| 2005/0155890 | A1 * | 7/2005 | Manuel | 206/523 |
| 2005/0211595 | A1 * | 9/2005 | Hull | 206/523 |

FOREIGN PATENT DOCUMENTS

| | | |
|---|---|---|
| EP | 1518795 A2 | 3/2005 |
| TW | 241380 | 8/2004 |

* cited by examiner

*Primary Examiner* — Jacob K Ackun
*Assistant Examiner* — Jenine Pagan
(74) *Attorney, Agent, or Firm* — Steven Bennett; Daniel E. McConnell

(57) ABSTRACT

An end cap which imparts fragility capability and which derives favorable characteristics by combining several cushioning effects. In particular, the end cap of this invention achieves cushioning by combining the effects of material compression, deformation of an arch, an expansion of contact area as cushioning occurs.

8 Claims, 4 Drawing Sheets

END CAP PACKAGING MATERIAL, PACKAGING AND METHOD FOR PROTECTING PRODUCTS AGAINST DAMAGE

FIELD AND BACKGROUND OF INVENTION

This invention relates to packaging materials, and more particularly to a cushion design, packaging in which the cushion design is used, and methods by which products are protected against damage otherwise possibly occurring due to shock loads (i.e. during distribution).

In developing a package for product protection, some fundamental information about the product is needed. To protect the product from shock, a fragility level must be determined. Fragility is the maximum acceleration and velocity change the product can withstand before damage occurs. This information is charted to form a damage boundary curve. Ideally the fragility level is determined experimentally through a test procedure such as American Society for Testing Materials (ASTM) D 3332 "Test Method for Mechanical-Shock Fragility of Products, Using Shock Machines." Fragility is usually expressed in units of "g's" (gravitational acceleration) and indicates the maximum acceleration the product can withstand without being damaged. Therefore, the more fragile a product is the lower its fragility level or g-factor. Ranges of a typical cushioning system include very delicate (25-40 g's), delicate (40-60 g's), and moderately delicate (60-85 g's)

Once the shock fragility is known for the product, a cushioning material and package configuration that will provide the necessary protection can be developed. Historically, the use of cushion curves helps a designer identify a material, thickness and loading range based on a pre-determined drop height and required acceleration level.

Packaging material and packages capable of handling determined loads are here referred to as having fragility capability. As will be understood, one of the tasks facing a packaging designer is to provide fragility capability suitable for the product to be packaged and the loads which may be imposed during handling. Another of the tasks facing the designer is that of providing material which can be easily fabricated and easily handled by persons preparing products for shipment.

One conventional type of cushion design is known as an end cap. An end cap is used to cover or receive the end of a product being inserted into a box, and in use a pair are positioned between the ends of a (typically) elongated product and the enclosing box. One use of end caps is in packaging notebook computers and computer components such as hard disk drives.

SUMMARY OF THE INVENTION

With the foregoing in mind, it is one purpose of this invention to provide an end cap which imparts fragility capability and which derives favorable characteristics by combining several cushioning effects. In particular, the end cap of this invention achieves cushioning by combining the effects of material compression, deformation of an arch, an expansion of contact area as cushioning occurs.

BRIEF DESCRIPTION OF DRAWINGS

Some of the purposes of the invention having been stated, others will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of the invention. Accordingly, the description which follows is to be understood as being a broad, teaching disclosure directed to persons of skill in the appropriate arts, and not as limiting upon the present invention.

Before proceeding with discussion of the characteristics of end caps and packaging in accordance with this invention, it will be helpful to establish some terminology related to the illustrations to be described. A product with which end caps are used typically has a pair of such caps mounted on opposite ends of the product. Here, the end of an end cap which faces an opposing end cap is referred to as the "inside" end. The end which faces away from the product is referred to as the "outside" end. As the product is inserted into a box, typically by inserting the product into an opened one of the larger sides of a rectilinear enclosure, the side of the end cap which becomes proximal to the bottom of the box is referred to as the "bottom" side. The opposite side of the end cap is referred to as the "top" side. Finally, the remaining sides of the end cap are here referred to as the left and right sides.

Persons familiar with end caps will readily understand that such caps are conventionally made in a single configuration, which is then used at opposite ends of a product being packaged and oriented appropriately for such use. Further, end caps are also used where products are inserted into boxes through an opened one of the smaller sides of a rectilinear enclosure. Therefore the terminology introduced here is to be understood as being solely an aid in understanding some of the configurations to be described, and not as limiting on the invention. The physical characteristics of the invention to be described here are what is significant, as distinguished from the terminology used in an effort to assure understanding.

As will become clear from the discussion which follows, an end cap protects a product with which it is engaged from potential damage which may otherwise occur from loads imposed (or resolved) along three orthogonal axes. Using the orienting terminology set out above, those orthogonal axes are directed end to end of the product, up and down, and left and right. The loads imposed may be borne by crushing or deformation of the material of the end cap. In accordance with this invention, the loads are also borne by the spring effect of an arched portion of the end cap material and by a resulting enlargement of the area of contact between the end cap and the enclosing box.

Figure 1:
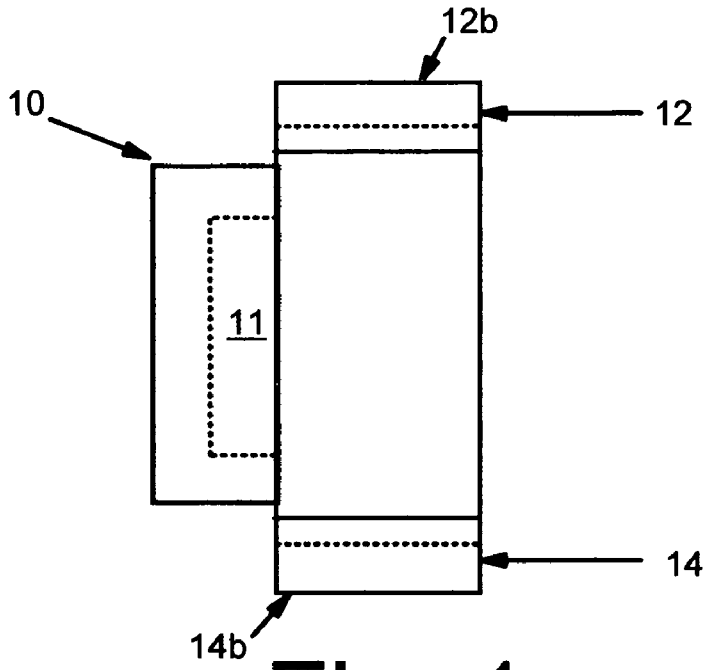
FIG. 1 is a side view of an end cap formed in accordance with this invention.
Figure 2:
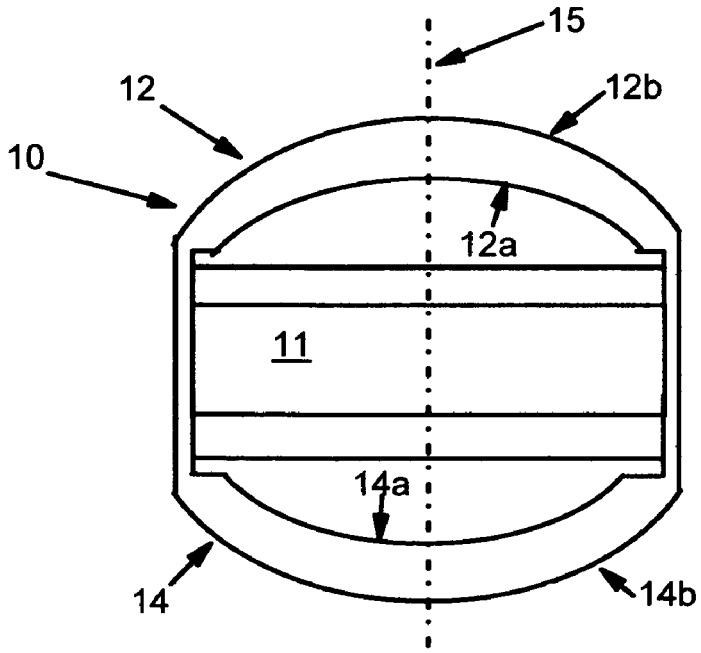
FIG. 2 is a front view of the end cap of FIG. 1.

With this discussion as background, FIGS. 1 and 2 illustrate, with elevation views including phantom lines, a unitary body of material 10 which forms a first type of end cap in accordance with this invention. FIG. 1 is a side view, taken from what will be, in use, either the left or right side of the end cap depending upon which end of a product the end cap is mounted upon. FIG. 2 is taken from the inside of the end cap. The body 10 defines a product receiving and supporting recess 11. In accordance with this invention, the body 10 also defines a pair of arched portions 12, 14 disposed on opposite sides of the recess 11 and defining a central axis (indicated at 15 in FIG. 2) transverse to the recess 11. Each of the arched portions 12, 14 has a curved inner surface 12*a*, 14*a* spaced from and concave toward the recess 11 and an outer surface 12*b*, 14*b* lying generally parallel to the inner surface 12*a*, 14*a* and defining an outer boundary for the body 10. The outer surfaces 12*b*, 14*b* define a contact surface for an enclosing package. The end cap body achieves fragility capability by the combined effects of the crush characteristics of the material of the body, the deformation characteristics of the arched portions 12, 14, and the enlargement of the area of contact between the enclosing package and the surfaces of the end cap upon deformation of the arched portions. The arched portions act somewhat as springs, while also being involved in enlarging the contact area as deformation occurs and taking up forces by deformation of the material of the body.

The body of material which forms the end cap device may be cast or molded from an appropriate foam or other material or may be fabricated by assembling parts to form the unitary body. It is contemplated for this invention that the end caps here described will enable a reduction in the quantity of material needed to form the end cap and also enable a reduction in the size of packaging for components packaged with this end cap as a consequence of the use of three characteristics to bear loads possibly imposed—material crush, arch spring, and arch expansion of contact area with an enclosing box.

Figure 3:
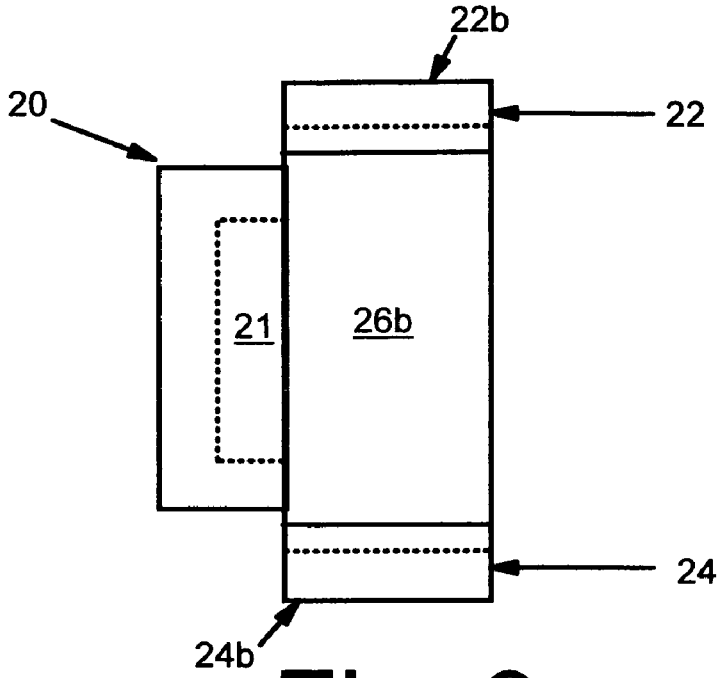
FIG. 3 is a view similar to FIG. 1 of a second form of end cap in accordance with this invention.
Figure 4:
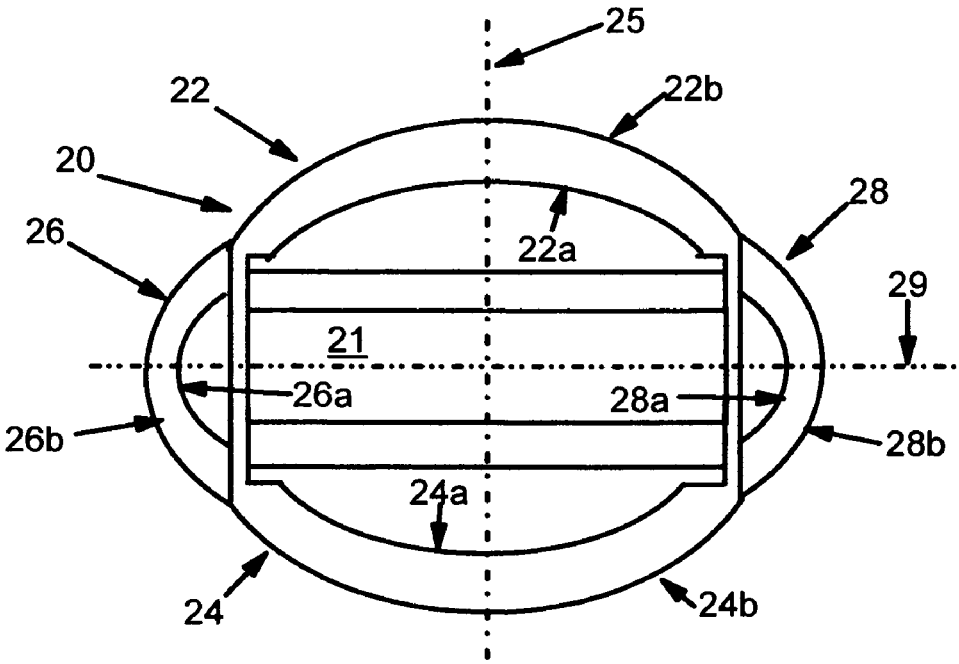
FIG. 4 is a front view of the end cap of FIG. 3.

Another type of end cap in accordance with this invention is shown in FIGS. 3 and 4, where comparable reference characters in a twenties order of magnitude are applied to comparable elements. The distinction between the end cap 10 of FIGS. 1 and 2 and the end cap 20 of FIGS. 3 and 4 lies in the provision of a second pair of arched portions 26, 28 disposed on opposite sides of the recess 21 and defining a corresponding central axis 29 transverse to the recess 21 and orthogonal to the central axis 25 defined by the other pair of arched portions 22, 24. Each of the second pair of arched portions 26, 28 has a curved inner surface 26*a*, 28*a* spaced from and concave toward the recess 21 and an outer surface 26*b*, 28*b* lying generally parallel to the inner surface 26*a*, 28*a* and defining an outer boundary for the end cap body 20. The provision of the second set of arched portions provides the three characteristic protection on a second axis of force application. Where the first pair 22, 24 provide protection along the top to bottom axis, the second pair provide protection along the side to side or right to left axis.

Figure 5:
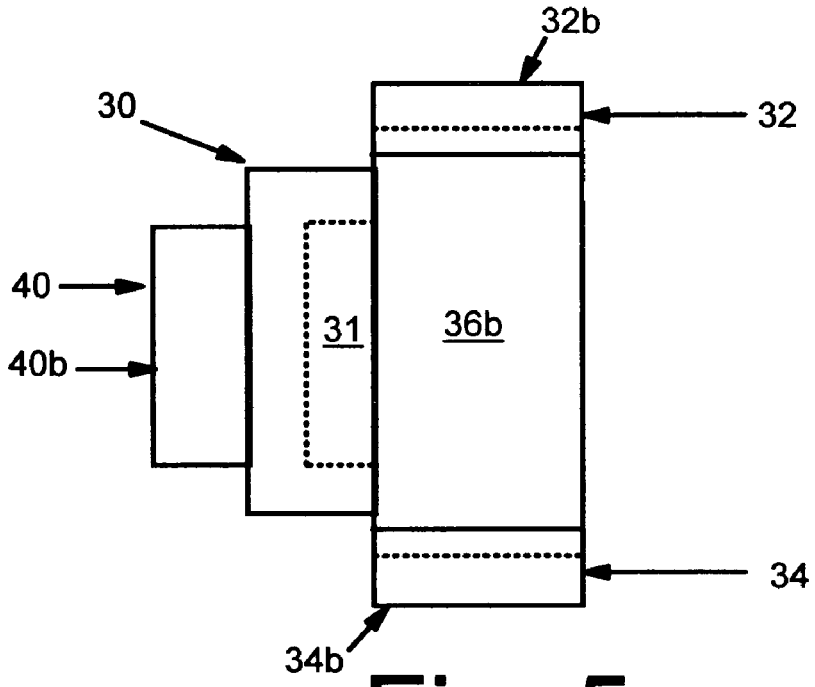
FIG. 5 is a view similar to FIGS. 1 and 3 of a third form of end cap in accordance with this invention.
Figure 6:
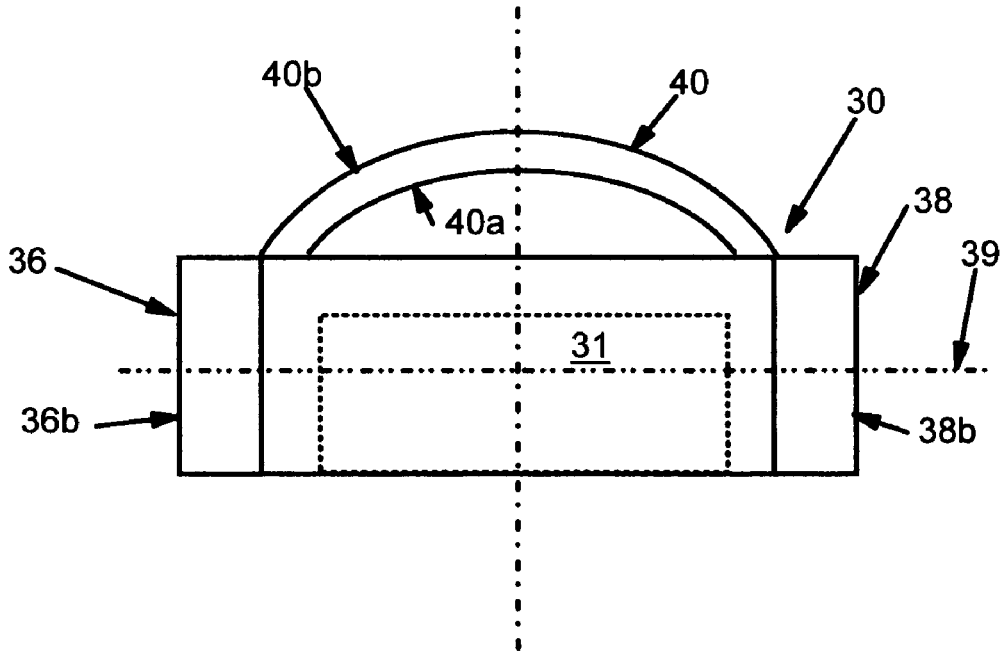
FIG. 6 is a plan view from above of the end cap of FIG. 5.

This invention contemplates a third type of end cap device, shown in FIGS. 5 and 6. The distinction is that the device of FIGS. 5 and 6 provides protection on three orthogonal axes. In FIGS. 5 and 6, comparable reference characters in a thirties order of magnitude are applied to comparable elements. As there shown, another arched portion 40 is formed on the outside surface of the end cap body 30. When a pair of end caps in accordance with this invention are mounted on a product to be protected, the provision of this additional arched portion provides protection against forces applied end to end of the product. The arched portion 40, as with the others described here, has a curved inner surface 40*a* spaced from and concave toward the product receiving recess 31 and an outer surface 40*b* lying generally parallel to the inner surface 40*a* and defining an outer boundary for the body 30. The arched portion 40 defines a corresponding central axis 41 orthogonal with the axes defined by the other four arched portions (one of which is shown in FIG. 6 at 39).

Figure 7:
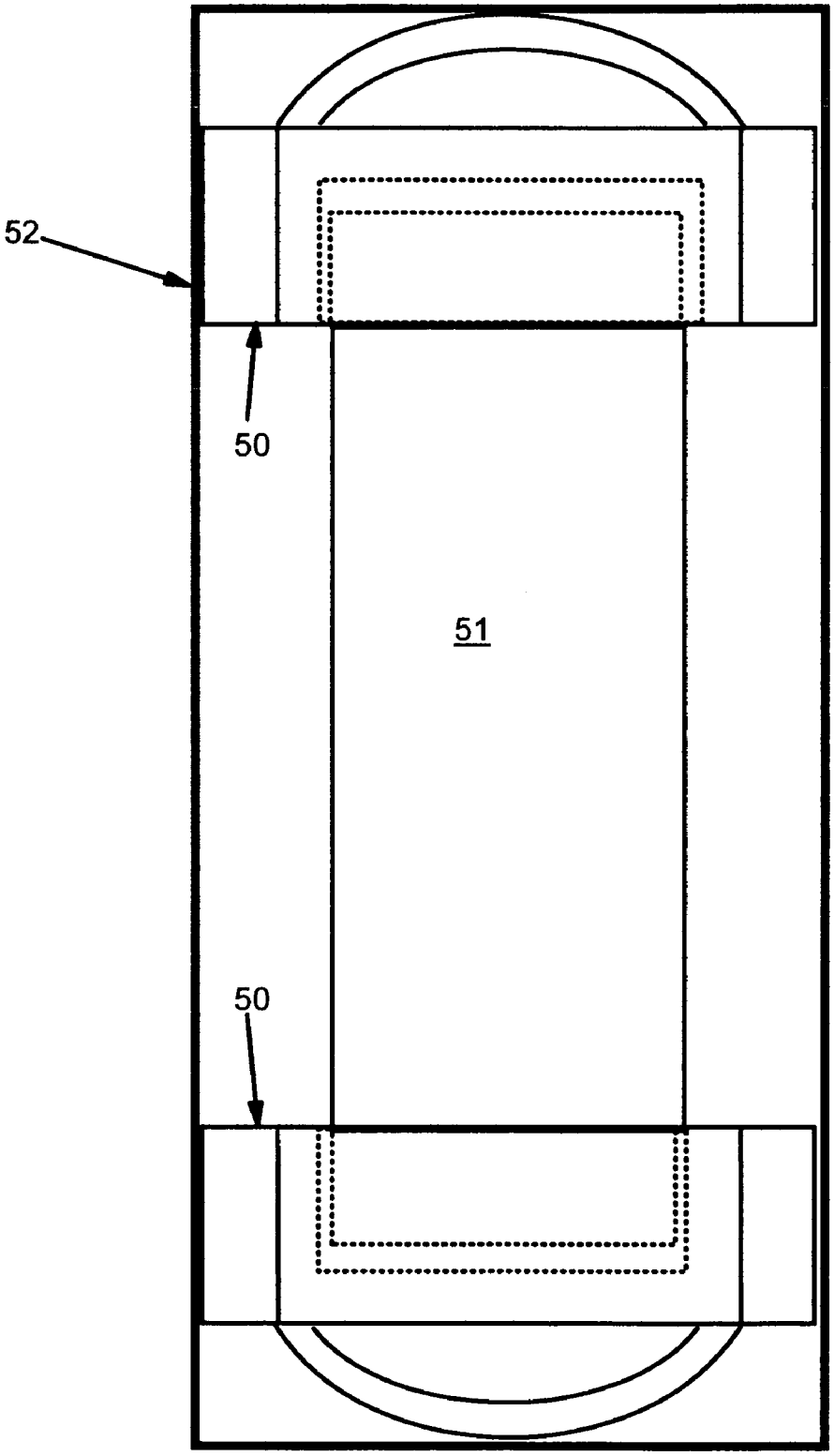
FIG. 7 is a plan view from above of a pair of the end caps of FIGS. 5 and 6 as engaged with a product disposed in a box.

As applied, end cap bodies 50 in accordance with this invention are shown in FIG. 7 to be positioned at either end of a product 51 disposed within a package or box 52. Those shown are of the third type. However, persons of skill will recognize that the end cap used may be of any of the three types, depending upon the anticipated loads to be encountered and other elements of package design. Thus the packaging illustration of FIG. 7 is to be understood as applicable to each of the three types of end caps here disclosed.

The present invention contemplates that the techniques here disclosed are amenable to practice of packaging methods. More particularly, one method which implements this invention involves mounting a pair of end cap bodies as here taught on opposite ends of a fragile product and inserting the bodies and product into an enclosing box as shown in FIG. 7. This procedure then protects the product against damage from externally applied loads by a combination of compression of the material of the end cap bodies and deformation of arched portions of said bodies which are spaced from and concave toward the product and enlargement of a contact area between the end cap bodies and the box upon deformation of the arched portions.

As practiced, this method includes forming an end cap body as a unitary body of cushioning packaging material defining a product receiving and supporting recess, mounting a pair of the end cap bodies on opposite ends of a fragile product, and inserting the product and the end cap bodies into an enclosing box. As here taught, the body defines a pair of arched portions disposed on opposite sides of the recess and defining a central axis transverse to the recess, each of the arched portions having a curved inner surface spaced from and concave toward the recess and an outer surface lying generally parallel to the inner surface and defining an outer boundary for the body, and an outer surface defining a contact surface for an enclosing box. The end caps achieve a fragility capability by combined effects of the crush characteristics of the material, the deformation characteristics of the arched portions, and the enlargement of the contact surface upon deformation of the arched portions;

In the drawings and specifications there has been set forth a preferred embodiment of the invention and, although specific terms are used, the description thus given uses terminology in a generic and descriptive sense only and not for purposes of limitation.

What is claimed is:

1. Apparatus comprising:

a unitary molded foam body of cushioning packaging material which has predetermined crush characteristics, said molded foam body defining a rectilinear frame surrounding and defining a product receiving and supporting recess;

said molded foam body when undeformed defining a pair of arched portions extending from said rectilinear frame, disposed on opposite sides of said recess and defining a central axis transverse to said recess, each of said arched portions having a curved inner surface spaced from and concave toward said recess and an outer surface lying generally parallel to said inner surface and defining an outer boundary for said molded foam body, each of said arched portions having predetermined deformation characteristics;

said outer surface defining a contact surface for an enclosing package and said deformation characteristics leading to enlargement of contact surfaces upon deformation of said arched portions, said molded foam body achieving a fragility capability by combined effects of the crush characteristics of said material, the deformation characteristics of said arched portions, and the enlargement of said contact surface upon deformation of said arched portions.

2. Apparatus according to claim 1 wherein said molded foam body when undeformed defines a third arched portion extending from said rectilinear frame, said third arched portion having a curved inner surface spaced from and concave toward said recess and an outer surface lying generally parallel to said inner surface and defining an outer boundary for said molded foam body; said third arched portion defining an axis orthogonal to said central axis defined by said pair of arched portions, said third arched portion having predetermined deformation characteristics and said deformation characteristics leading to enlargement of contact surfaces upon deformation of said third arched portion.

3. Apparatus according to claim 1 wherein said molded foam body when undeformed defines a second pair of arched portions extending from said rectilinear frame and disposed on opposite sides of said recess and defining a corresponding central axis transverse to said recess and orthogonal to said first pair central axis, each of said second pair arched portions having a curved inner surface spaced from and concave toward said recess and an outer surface lying generally parallel to said inner surface and defining an outer boundary for said molded foam body, each of said second pair of arched portions having predetermined deformation characteristics and said deformation characteristics leading to enlargement of contact surfaces upon deformation of each of said second pair of arched portions.

4. Apparatus according to claim 1 wherein said molded foam body when undeformed defines a second pair of arched portions extending from said rectilinear frame and disposed on opposite sides of said recess and defining a corresponding central axis transverse to said recess and orthogonal to said first pair central axis, each of said second pair arched portions having a curved inner surface spaced from and concave toward said recess and an outer surface lying generally parallel to said inner surface and defining an outer boundary for said molded foam body, each of said second pair of arched portions having predetermined deformation characteristics and said deformation characteristics leading to enlargement of contact surfaces upon deformation of each of said second pair of arched portions;

said molded foam body when undeformed defines a fifth arched portion, said fifth arched portion extending from said rectilinear frame and having a curved inner surface spaced from and concave toward said recess and an outer surface lying generally parallel to said inner surface and defining an outer boundary for said molded foam body; said fifth arched portion defining an axis orthogonal to said central axes defined by said and second pairs of arched portions, said fifth arched portion having predetermined deformation characteristics and said deformation characteristics leading to enlargement of contact surfaces upon deformation of said fifth arched portion.

5. Apparatus comprising:

a box;

a fragile product contained within said box; and a pair of protective cushioning end cap bodies interposed between said product and said box, each of said bodies being a unitary molded foam body of cushioning material which has predetermined crush characteristics and which when undeformed:

defines a rectilinear frame surrounding and defining a product receiving and supporting recess;

defines a pair of arched portions extending from said rectilinear frame and disposed on opposite sides of said recess and a central axis transverse to said recess, each of said arched portions having a curved inner surface spaced from and concave toward said recess and an outer surface lying generally parallel to said inner surface and defining an outer boundary for said molded foam body each of said arched portions having predetermined deformation characteristics; and defines a contact surface for said box which becomes enlarged upon deformation of said arched portions, each of said molded foam bodies achieving a fragility capability by combined effects of the crush characteristics of said material, the deformation characteristics of said arched portions, and the enlargement of said contact surface upon deformation of said arched portions.

6. Apparatus according to claim 5 wherein each of said molded foam bodies when undeformed defines a third arched portion extending from said rectilinear frame, said third arched portion having a curved inner surface spaced from and concave toward said recess and an outer surface lying generally parallel to said inner surface and defining an outer boundary for said body; said third arched portion defining an axis orthogonal to said central axis defined by said pair of arched portions said third arched portion having predetermined deformation characteristics and said deformation characteristics leading to enlargement of contact surfaces upon deformation of said third arched portion.

7. Apparatus according to claim 5 wherein each of said molded foam bodies when undeformed defines a second pair of arched portions extending from said rectilinear frame and disposed on opposite sides of said recess and defining a corresponding central axis transverse to said recess and orthogonal to said first pair central axis, each of said second pair arched portions having a curved inner surface spaced from and concave toward said recess and an outer surface lying generally parallel to said inner surface and defining an outer boundary for said molded foam body each of said second pair of arched portions having predetermined deformation characteristics and said deformation characteristics leading to enlargement of contact surfaces upon deformation of each of said second pair of arched portions.

8. Apparatus according to claim 5 wherein each of said molded foam bodies when undeformed defines a second pair of arched portions extending from said rectilinear frame and disposed on opposite sides of said recess and defining a corresponding central axis transverse to said recess and orthogonal to said first pair central axis, each of said second pair arched portions having a curved inner surface spaced from and concave toward said recess and an outer surface lying generally parallel to said inner surface and defining an outer boundary for said molded foam body each of said second pair of arched portions having predetermined deformation characteristics and said deformation characteristics leading to enlargement of contact surfaces upon deformation of each of said second pair of arched portions;

each of said molded foam bodies when undeformed defines a fifth arched portion extending from said rectilinear frame, said fifth arched portion having a curved inner surface spaced from and concave toward said recess and an outer surface lying generally parallel to said inner surface and defining an outer boundary for said molded foam body; said fifth arched portion defining an axis orthogonal to said central axes defined by said first and second pairs of arched portions said fifth arched portion having predetermined deformation characteristics and said deformation characteristics leading to enlargement of contact surfaces upon deformation of said fifth arched portion.

* * * * *